US008042551B2

(12) United States Patent
Tabuchi et al.

(10) Patent No.: US 8,042,551 B2
(45) Date of Patent: Oct. 25, 2011

(54) DOUBLE WRAPPER CIGARETTE, MACHINE AND METHOD FOR MANUFACTURING THE SAME

(75) Inventors: Hiromi Tabuchi, Tokyo (JP); Masaomi Fukamachi, Tokyo (JP); Hidetoshi Okuyama, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 372 days.

(21) Appl. No.: 10/771,328

(22) Filed: Feb. 5, 2004

(65) Prior Publication Data

US 2004/0154630 A1 Aug. 12, 2004

Related U.S. Application Data

(63) Continuation of application No. PCT/JP02/07463, filed on Jul. 24, 2002.

(30) Foreign Application Priority Data

Aug. 7, 2001 (JP) ..... 2001-239182

(51) Int. Cl.
*A24D 3/04* (2006.01)
*A24C 5/08* (2006.01)

(52) U.S. Cl. ..... 131/335; 131/58

(58) Field of Classification Search ..... None
See application file for complete search history.

(56) References Cited

U.S. PATENT DOCUMENTS

| | | | | | |
|---|---|---|---|---|---|
| 2,320,702 | A * | 6/1943 | Marchese et al. | ..... | 427/289 |
| 2,999,520 | A * | 9/1961 | Lowman | ..... | 83/73 |
| 4,624,268 | A * | 11/1986 | Baker et al. | ..... | 131/332 |
| 5,143,099 | A * | 9/1992 | Le Gars et al. | ..... | 131/365 |
| 5,159,944 | A | 11/1992 | Arzonico et al. | | |
| 5,462,073 | A | 10/1995 | Bowen et al. | | |
| 5,494,055 | A * | 2/1996 | Noe et al. | ..... | 131/365 |
| 5,709,228 | A | 1/1998 | Cohen et al. | | |
| 5,979,461 | A | 11/1999 | Bensalem et al. | | |
| 2001/0009938 | A1 * | 7/2001 | Eckstein et al. | ..... | 524/86 |
| 2002/0074007 | A1 * | 6/2002 | Miyauchi et al. | ..... | 131/274 |

FOREIGN PATENT DOCUMENTS

| | | | | | |
|---|---|---|---|---|---|
| CA | 02381634 | * | 2/2002 | ..... | 131/280 |
| DE | 19751691 | A1 | 6/1998 | | |
| DE | 19905520 | A1 | 8/1999 | | |
| EP | 0375844 | A2 | 7/1990 | | |
| EP | 0533423 | A1 | 3/1993 | | |
| EP | 0 559 300 | A2 | 9/1993 | | |
| EP | 0558254 | A2 | 9/1993 | | |
| JP | 11-178562 | A | 7/1999 | | |
| JP | 2000-96493 | A | 4/2000 | | |
| WO | WO 99/35923 | A1 | 7/1999 | | |
| WO | WO/2001/15555 | A1 * | 8/2000 | ..... | 131/280 |

* cited by examiner

*Primary Examiner* — Matthew Daniels

*Assistant Examiner* — Russell Kemmerle, III

(74) *Attorney, Agent, or Firm* — Birch, Stewart, Kolasch & Birch, LLP

(57) ABSTRACT

A double wrapper cigarette produced by a manufacturing machine and method according to the invention includes an inner wrapper (6) wrapped around a rod-like filler including a tobacco material, an outer wrapper (8) surrounding the inner wrapper (6), and a perfume emitting layer (10) provided between the inner wrapper (6) and the outer wrapper (8). The perfume emitting layer (10) includes a perfume material for weakening odor of sidestream smoke of the cigarette.

8 Claims, 4 Drawing Sheets

DOUBLE WRAPPER CIGARETTE, MACHINE AND METHOD FOR MANUFACTURING THE SAME

This application is a Continuation of copending PCT International Application No. PCT/JP02/07463 filed on Jul. 24, 2002, which designated the United States, and on which priority is claimed under 35 U.S.C. §120, the entire contents of which are hereby incorporated by reference.

TECHNICAL FIELD

The invention relates to a double wrapper cigarette, more specifically, a double wrapper cigarette which can weaken odor of sidestream smoke, and a machine and method for manufacturing the cigarette.

BACKGROUND ART

When a cigarette is smoked, sidestream smoke tends to give an uncomfortable feeling to not only a smoker but also people around the smoker, which prevents the smoker from enjoying smoking.

Considering this, cigarettes reduced in sidestream smoke have been developed. Cigarettes of this type include special additives in their wrappers. The special additives are effective in reducing sidestream smoke but often strengthen the odor of the sidestream smoke compared with standard cigarettes.

It is thought that the odor of the sidestream smoke can be weakened by adding a perfume material to a cigarette. Specifically, a perfume material can be added to the filler of a cigarette or seam glue applied on a wrapper thereof.

However, when a perfume material is added to the filler, the perfume material damages the filler's original aroma and taste. When a perfume material is to be added to seam glue, it is difficult to add a sufficient amount of the perfume material to the seam glue without lowering the adhesive force of the seam glue.

DISCLOSURE OF THE INVENTION

An object of the invention is to provide a double wrapper cigarette which can satisfactorily weaken odor of sidestream smoke without the above-mentioned problems, and a method and machine for manufacturing the double wrapper cigarette.

A double wrapper cigarette which can achieve the above object comprises a rod-like filler including a tobacco material, an inner wrapper wrapped around the filler, an outer wrapper surrounding the inner wrapper, and a perfume emitting layer provided between the inner and outer wrappers, where the perfume emitting layer includes a perfume material for weakening odor of sidestream smoke.

When this double wrapper cigarette is smoked, the perfume emitting layer emits perfume, which weakens odor of sidestream smoke. Since the perfume emitting layer is provided between the inner and outer wrappers, the perfume does not penetrate into mainstream smoke. Hence, the filler's original aroma and taste is not damaged by the perfume. Further, since the perfume emitting layer can be formed in a large area between the inner and outer wrappers, it can include a sufficient amount of the perfume material to weaken the odor of the sidestream smoke.

The inner and outer wrappers may include an additive for reducing sidestream smoke. In this case, when the double wrapper cigarette is smoked, the sidestream smoke produced therefrom is reduced.

Specifically, if the perfume material is soluble, the perfume emitting layer is formed by applying a perfume emitting liquid including the perfume material onto at least one of the inner and outer wrappers.

If the perfume material is insoluble, the perfume emitting layer may include glue for carrying the perfume material. It is favorable that the glue is polyvinyl acetate glue. In this case, it is desirable that the perfume material is in powder or grain form.

A machine for manufacturing this double wrapper cigarette comprises a first feeding path along which an inner web is fed; a second feeding path along which an outer web is fed; a wrapping section for continuously forming a tobacco rod by receiving the inner and outer webs from the first and second feeding paths, laying the inner web on the outer web to thereby form a double web, receiving a filler including a tobacco material on the double web, and wrapping the double web around the filler; a cutting section for cutting the tobacco rod formed at the wrapping section into cigarette rods of a predetermined length; and at least one perfume material supply device provided along at least one of the first and second feeding paths, where the perfume material supply device is so provided as to apply material including a perfume onto the web on the at least one of the first and second feeding paths in the form of a layer, to thereby form a perfume emitting layer between the inner and outer webs for the double web.

In this manufacturing machine, a tobacco rod is formed by wrapping a filler in a double web including a perfume emitting layer, and then, a double wrapper cigarette is produced by cutting the tobacco rod.

If a soluble perfume material is used, the perfume material supply device may include a nozzle type applicator for applying a perfume emitting liquid including the perfume material onto the web.

If an insoluble perfume material is used, the perfume material supply device may include a glue applicator for applying glue onto the web to form an adhesive surface, and a diffuser for diffusing a perfume emitting material in powder or grain form over the adhesive surface of the web.

The diffuser may include a first brush roller rotatably located under the feeding path for the web, for blowing up the perfume emitting material toward the adhesive surface of the web, and a second brush roller rotatably located downstream of the first brush roller, for removing a surplus of the perfume emitting material attached to the adhesive surface.

In this blowing-up type diffuser, the amount of the perfume emitting material to be attached to the adhesive surface of the web can be controlled easily.

A method of manufacturing a double wrapper cigarette comprises the steps of feeding an inner web and an outer web to a wrapping section of a cigarette manufacturing machine, and, at an inlet of the wrapping section, laying the inner web on the outer web to thereby form a double web; applying material including a perfume onto at least one of the inner and outer webs in the form of a layer while the inner and outer webs are being fed, to thereby form a perfume emitting layer between the inner and outer webs; supplying a filler including a tobacco material onto the double web at the inlet of the wrapping section; forming a tobacco rod continuously by wrapping the double web around the filler while the double web is passing through the wrapping section with the filler; and then cutting the tobacco rod into cigarette rods of a predetermined length.

In the above-described machine and method for manufacturing a double wrapper cigarette, a double wrapper cigarette can be easily manufactured by forming a perfume emitting layer on at least one of inner and outer webs while the inner and outer webs are being fed to the wrapping section.

BEST MODE OF CARRYING OUT THE INVENTION

Figure 1:
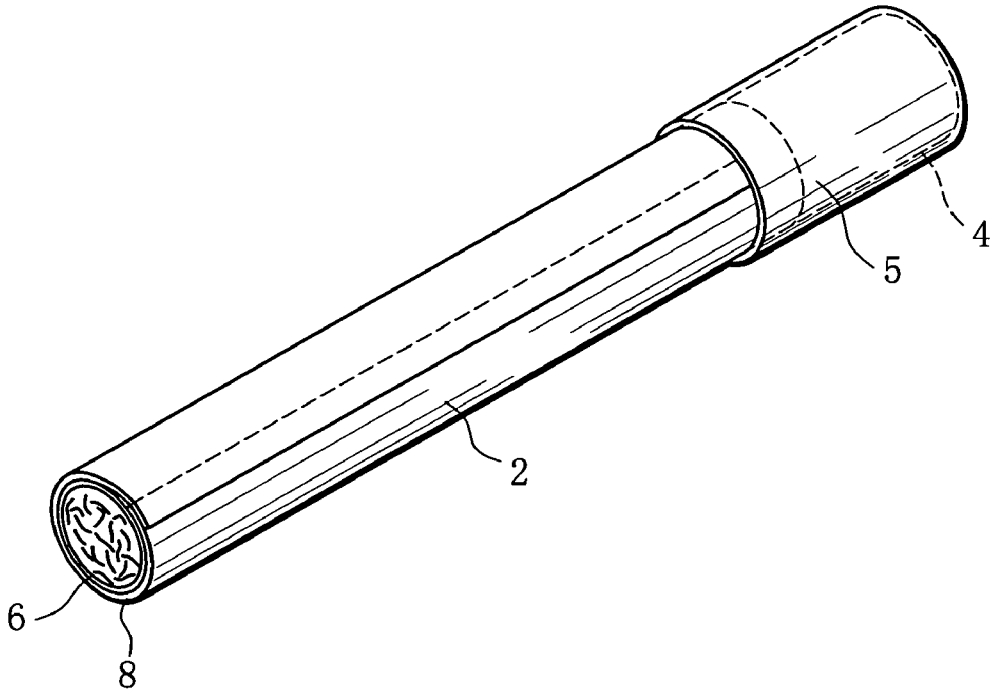
FIG. 1 is a prospective view of a filter cigarette which includes an embodiment of a double wrapper cigarette.

FIG. 1 shows a filter cigarette. The filter cigarette includes a double wrapper cigarette 2. A filter tip 4 is connected to an end of the double wrapper cigarette 2 by a tip paper piece 5.

The double wrapper cigarette 2 includes an inner wrapper 6 and an outer wrapper 8. The inner wrapper 6 is directly wrapped around filler K and forms the filler K into a rod-like shape. The outer wrapper 8 surrounds the inner wrapper 6 concentrically.

Figure 2:
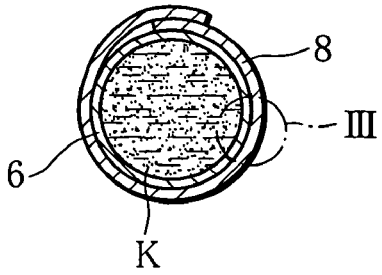
FIG. 2 is a cross-sectional view of the double wrapper cigarette of FIG. 1.

As seen from FIG. 2, the opposite side edges of the outer wrapper 8 are overlapped and joined with seam glue (not shown), while the opposite side edges of the inner wrapper 6 are not overlapped. Hence, when developed, the inner wrapper 6 is smaller in width than the outer wrapper 8.

The filler K is a mixture of shredded tobacco obtained by shredding tobacco laminae and midribs thereof, shreds obtained by shredding reconstructed sheet tobacco, and expanded shredded tobacco.

The inner wrapper 6 and the outer wrapper 8 are both obtained by adding an additive for reducing sidestream smoke to flax pulp, wood pulp or other plant pulp. Here, as the additive, for example, calcium carbonate, a magnesium compound or the like is used. The inner wrapper 6 and the outer wrapper 8 may include a combustion conditioning agent such as a salt of an organic acid, and an ash conditioning agent such as phosphate. The basis weight of the inner and outer wrappers 6 and 8 is 10 to 100 $g/m^2$.

Figure 3:
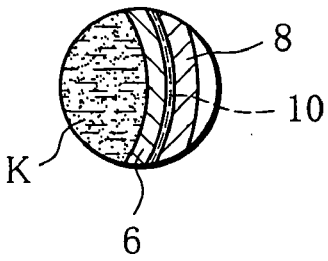
FIG. 3 is an enlarged view of part III of FIG. 2.

As shown in FIG. 3, the double wrapper cigarette 2 also includes a perfume emitting layer 10 between the inner wrapper 6 and the outer wrapper 8. The perfume emitting layer 10 covers the entire outer circumferential surface of the inner wrapper 6 or a part thereof. The perfume emitting layer 10 includes a perfume material. When the double wrapper cigarette is smoked, the perfume material weakens odor of sidestream smoke produced at the combustion end of the double wrapper cigarette. Here, the perfume material is a substance chosen from among tempels, esters, alcohol such as linalool, nerol and geraniol, phenols such as anethol, aldehydes such as vanillin and ethyl vanillin, lactones, plant extract, fruit extract and the like, or a mixture of some of these substances.

Figure 4:
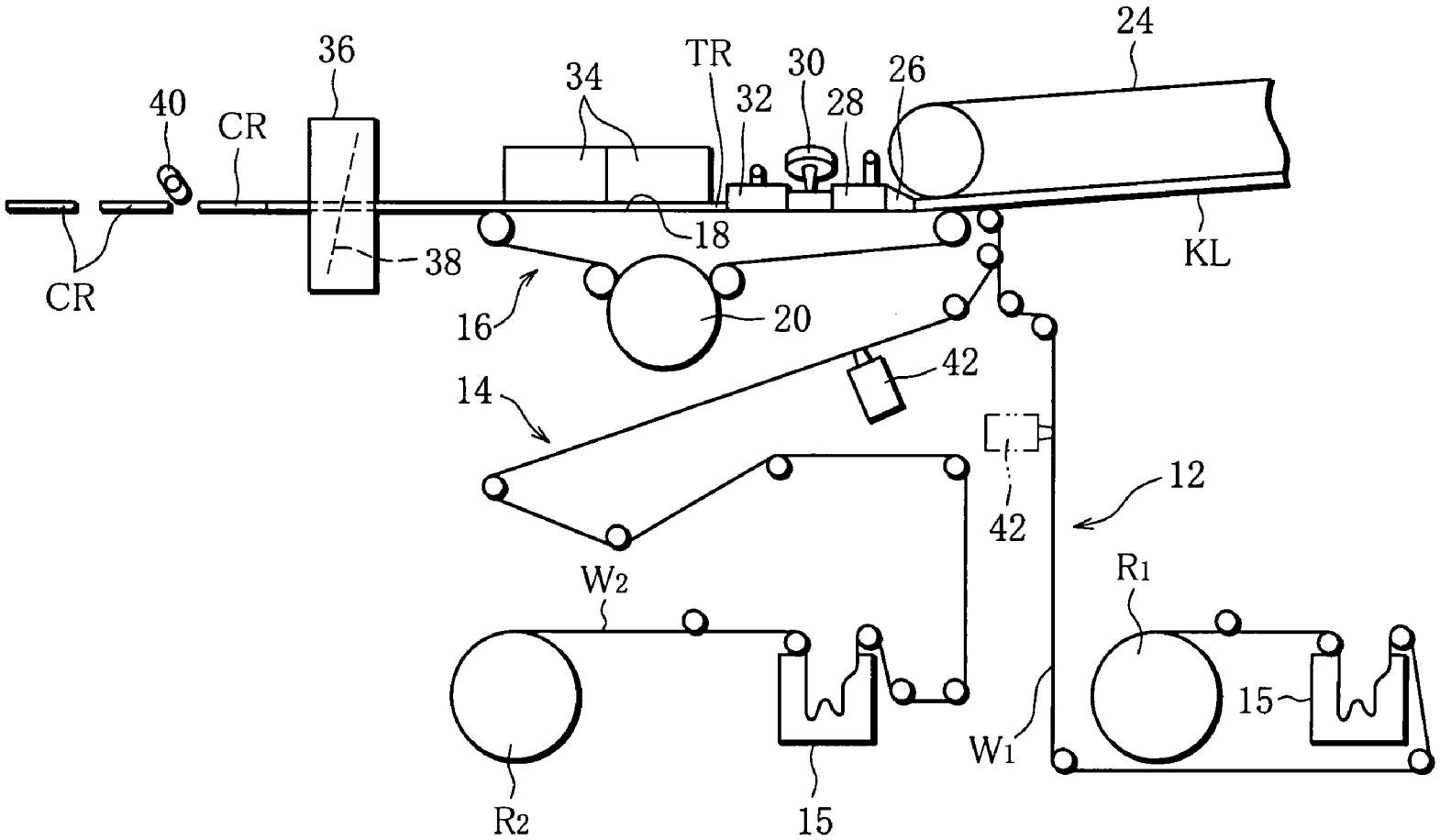
FIG. 4 is a schematic illustration showing a machine for manufacturing the double wrapper cigarette of FIG. 1.

FIG. 4 shows a manufacturing machine for the above-described double wrapper cigarette, which will be explained below.

A roll $R_1$ of inner web $W_1$ and a roll $R_2$ of outer web $W_2$ are provided in the manufacturing machine. The inner wrapper 6 is obtained from the inner web $W_1$, while the outer wrapper 8 is obtained from the outer web $W_2$. From the rolls $R_1$ and $R_2$ extend feeding paths 12 and 14, respectively. The feeding paths 12 and 14 are formed by a plurality of guide rollers, and have ends connected to an inlet of a wrapping section 16.

The feeding paths 12 and 14 each include a feed roller (not shown) and a reservoir 15. The feed rollers feed the inner web $W_1$ and the outer web $W_2$ from the roll $R_1$ and the roll $R_2$ along the feeding path 12 and the feeding path 14 to the wrapping section 16, respectively.

The wrapping section 16 includes an endless garniture tap 18. The garniture tape 18 is wound around a driving drum 20, and passes through a forming bed in the wrapping section 16, horizontally.

Figure 5:
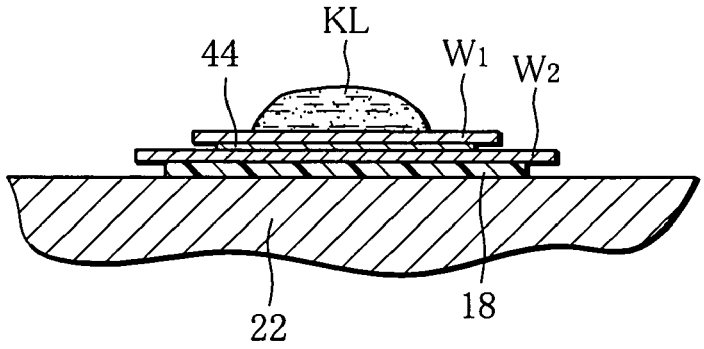
FIG. 5 is a cross-sectional view showing an inner wrapper and an outer wrapper supplied to an inlet of a wrapping section of the manufacturing machine of FIG. 4.

When the outer web $W_2$ and the inner web $W_1$ are fed to the wrapping section 16, the outer web $W_2$ and the inner web $W_1$ are laid on the garniture tape 18 on the forming bed 22 in the wrapping section 16 in this order, as shown in FIG. 5. Thus, the outer web $W_2$ and the inner web $W_1$ form a double web.

In this state, when the driving drum 20 is rotated, the garniture tape 18 travels with the double web in one direction. Thus, the double web passes through the forming bed 22 in the wrapping section 16 with the garniture tape 18. Specifically, the forming bed 22 has a forming groove (not shown) for guiding the garniture tape 18 and the double web. The width of the forming groove and the radius of curvature of the bottom of the forming groove decreases gradually from the inlet to the outlet of the wrapping section 16. At the outlet of the wrapping section 16, the forming groove has a nearly semicircular cross section.

At the inlet of the wrapping section 16, a layer of filler KL is fed onto the double web, or in other words, the inner web $W_1$. Specifically, the layer of filler KL is formed by sucking and thereby holding filler in a layer on the under surface of an endless tobacco band 24. As the tobacco band 24 travels, the filler layer KL is transported to the inlet of the wrapping section 16. Then, at the inlet of the wrapping section 16, the filler layer KL is separated from the tobacco band 24 by a tongue shoe 26 and transferred onto the inner web $W_1$.

Then, the filler layer KL passes through the tongue shoe 26, a short holder 28, a glue application nozzle 30 and a long holder 32 in the wrapping section 16, in this order, together with the double web. In this process, the filler layer KL is wrapped in the double web, so that a tobacco rod TR is formed continuously. The tobacco rod TR is transported downstream of the outlet of the wrapping section 16.

Specifically, the tongue shoe 26 compresses the filler layer KL from above to form the upper part of the filler layer KL into a semicircular cross section, while the forming groove of the forming bed 22 forms the double web into an U-like cross section, together with the help of the garniture tape 18. Thus, also the lower part of the filler layer KL is formed into a semicircular cross section. To sum up, the filler layer KL is compressed from above and below and formed into a circular cross section.

The short holder 28 bends one side edge portion of the double web, namely the inner and outer webs $W_1$ and $W_2$ into an arch shape with the help of the garniture tape 18, and puts the one side edge portion over a half of the upper part of the filler layer KL. The glue application nozzle 30 applies seam glue onto the other side edge of the double web, namely the outer web $W_2$.

Then, the long holder 32 bends the other side edge portion of the double web into an arch shape with the help of the garniture tape 18 likewise, and puts the other side edge portion over the other half of the upper part of the filler layer KL. Thus, the other side edge of the outer web $W_2$ is placed on the one side edge thereof with the seam glue between, so that the both side edges of the outer web $W_2$ are glued together. As a result, a tobacco rod TR is formed.

The tobacco rod TR transported from the wrapping section 16 has its seam glue dried while passing under a heater 34. Then, while the tobacco rod TR is passing through the cutting section 36, a rotary knife 38 in the cutting section 36 cuts the tobacco rod TR into pieces of a predetermined length. Thus, cigarette rods CR are formed. Here, the cigarette rod CR is twice as long as the double wrapper cigarette 2. Then, the cigarette rods CR are fed to a filter cigarette manufacturing machine (not shown) by a kicker 40.

After fed to the filter cigarette manufacturing machine, each cigarette rod CR is first cut into two double wrapper cigarettes 2, and a filter plug is placed between the two double wrapper cigarettes 2. Then, the two double wrapper cigarettes are connected with the filter plug by wrapping a tip paper piece around them. Thus, a double filter cigarette is formed. Then, the double filter cigarette is cut into two equal parts. As a result, filter cigarettes as shown in FIG. 1 are obtained.

The manufacturing machine of FIG. 4 further includes a nozzle-type applicator 42 along the feeding path 14 for the outer web $W_2$. Specifically, the applicator 42 is located between the reservoir 15 and the wrapping section 16.

The applicator 42 applies a perfume emitting liquid onto one surface, namely the inner surface of the outer web $W_2$. The area where the perfume emitting liquid is applied does not include the other side edge of the outer web $W_2$ to which the seam glue is applied. When the inner web $W_1$ is laid on the outer web $W_2$ with the perfume emitting liquid applied on at the inlet of the wrapping section 16, a layer 44 of the perfume emitting liquid is formed between the webs $W_1$ and $W_2$ as shown in FIG. 5.

The perfume emitting liquid is obtained by mixing the above-mentioned perfume material with EVA glue or PVAC glue as a carrier. EVA glue and PVAC glue are glues which are used as seam glue. Hence, the layer 44 functions also as an adhesive for joining the inner web $W_1$ and the outer web $W_2$ together.

As a carrier, PVAC glue is better in the capability of retaining the perfume material than EVA glue and CMC glue, and can emit the perfume into sidestream smoke better.

When the layer 44 is formed on the inner surface of the outer wrapper $W_2$, the layer 44 functions as the perfume emitting layer 10 of the double wrapper cigarette 2.

The invention is not limited to the above-described embodiment. Various modifications can be made.

For example, the applicator 42 may form a layer 44 consisting of a plurality of streak-like parts, on the inner surface of the outer web $W_2$.

If the applicator 42 is provided along the feeding path 12 as indicated by a chain double-dashed line in FIG. 4, the applicator 42 can form a layer 44 on a surface of the inner web $W_1$, namely the inner surface thereof which faces the outer web $W_2$. In this case, the layer 44 may cover the entire inner surface of the inner web $W_1$.

Applicators 42 may be provided along the feeding path 12 and along the feeding path 14, respectively. In this case, layers 44 are formed both on the inner wrapper $W_1$ and on the outer wrapper $W_2$, respectively, which allows a larger amount of the perfume material to be retained between the inner and outer wrappers $W_1$, $W_2$.

In place of the nozzle type applicator 42, a roller type applicator may be used. The roller type applicator includes a transfer roller, which transfers a perfume emitting liquid to the inner web $W_1$ or the outer web $W_2$ and thereby forms a layer 44.

Figure 6:
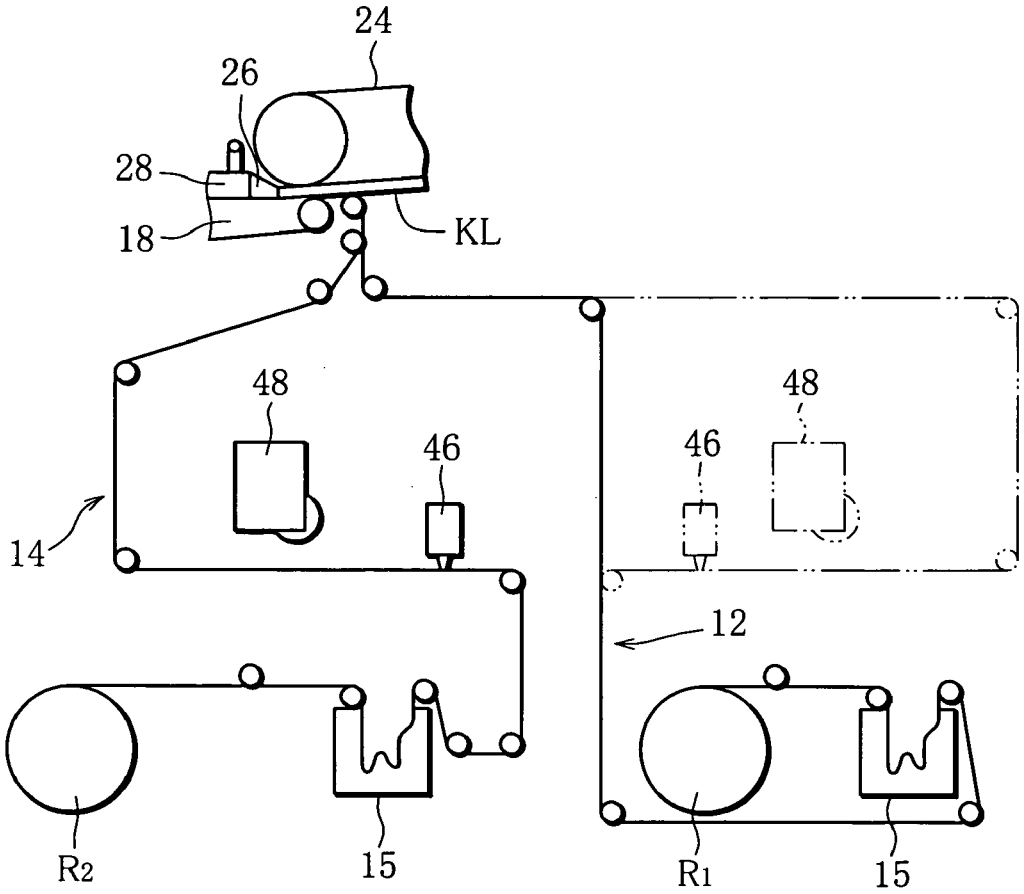
FIG. 6 is a schematic illustration showing a manufacturing machine with a supply apparatus for supplying a perfume material in powder or grain form to a web.

The manufacturing machine may have a supply device for supplying a perfume emitting material in powder or grain form. Specifically, as shown in FIG. 6, the supply device includes a glue applicator 46 and a diffuser 48 provided along the feeding path 14. The diffuser 48 is located downstream of the glue applicator 46. The glue applicator 46 applies PVAC glue onto the inner surface of the outer web $W_2$ and thereby makes the inner surface of the outer web $W_2$ an adhesive surface. Then, the diffuser 48 diffuses a perfume emitting material in powder or grain form over the adhesive surface of the outer web $W_2$, so that the perfume emitting material is attached to the adhesive surface in the form of a layer.

As the perfume emitting material, dextrin powder perfum, curdlan powder, or powder perfume including β-cyclodextrin or the like as a carrier and any of the mentioned perfume materials can be used.

Also when the perfume emitting materials as mentioned above are used, a perfume emitting layer can be formed between the inner web $W_1$ and the outer web $W_2$, and the double wrapper cigarette described above can be obtained.

As indicated by a chain double-dashed line in FIG. 6, the supply device may be provided along the feeding path 12. The supply devices may be provided along the feeding path 12 and along the feeding path 14, respectively.

Figure 7:
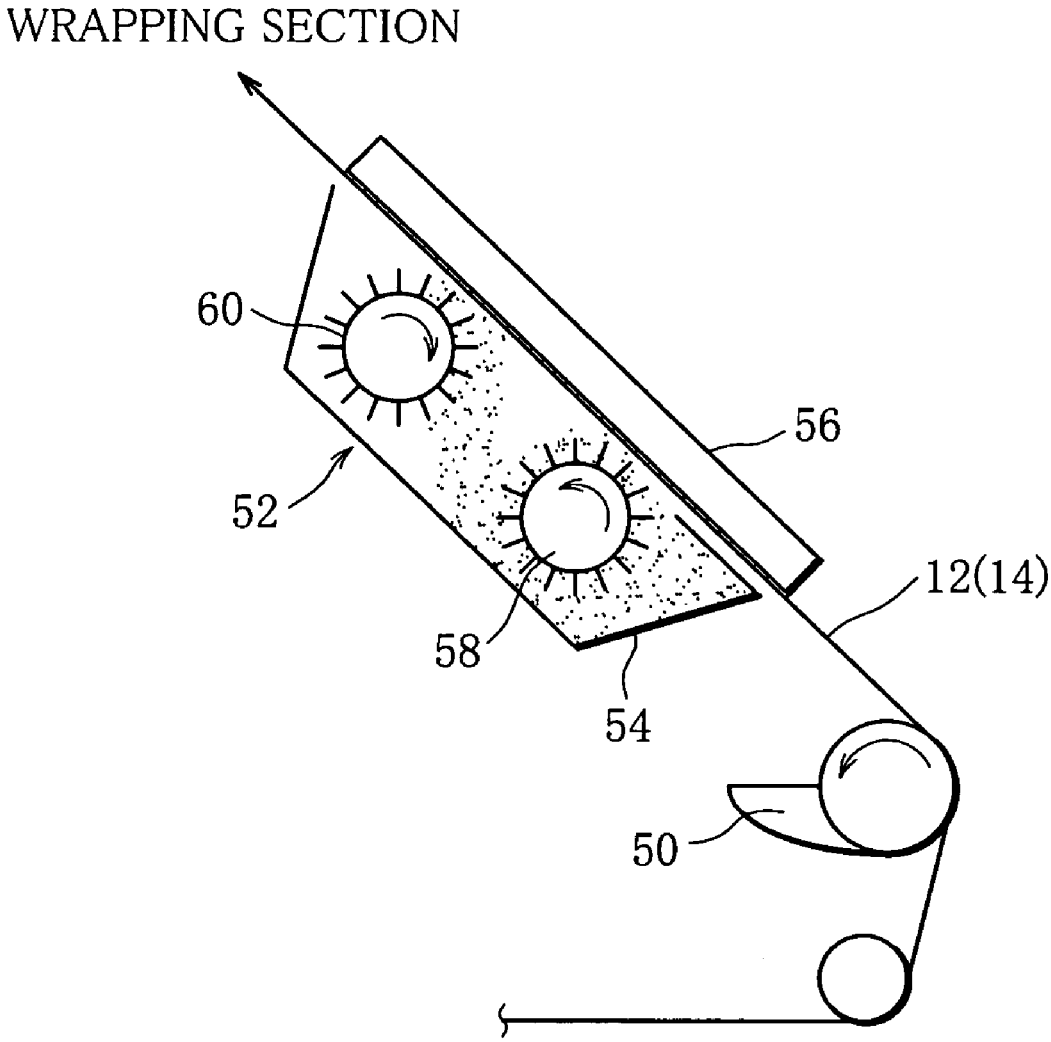
FIG. 7 is a schematic illustration showing another supply apparatus.

In place of the above-described supply device, a supply device shown in FIG. 7 may be used.

The supply device of FIG. 7 includes at least one glue applicator 50 provided along the feeding path 12 and/or along the feeding path 14. The glue applicator 50 includes a glue pot and a transfer roller. The transfer roller of the glue applicator 50 applies PVAC glue stored in the glue pot onto a surface of a web and thereby makes it an adhesive surface.

The feeding path includes an upward slanting part downstream of the glue applicator 50, and a blowing-up type diffuser 52 is provided along this slanting part. The diffuser 52 has a housing 54 and a cover 56 which are arranged under and over the slanting part, respectively, and extend along the slanting part. Specifically, the housing 54 is arranged under the feeding path and the top of the housing 54 is partly open. The cover 56 covers the top of the housing 54, and a web travels between the housing 54 and the cover 56.

A perfume emitting material in powder or grain form is stored in the housing 54, and two brush rollers 58 and 60 are rotatably arranged inside the housing 54. The blush rollers 58, 60 are apart from each other in the direction in which the web travels, and only the brush roller 58 is partly buried in the perfume emitting material.

As the brush rollers 58 and 60 rotate, the brush roller located upstream, namely the lower brush roller 58 blows up the perfume emitting material stored in the housing 54 toward the web, so that the perfume emitting material is attached to the adhesive surface of the web in the form of a layer. Then, the brush roller located downstream, namely the upper brush roller 60 removes a surplus of the perfume emitting material from the adhesive surface of the web. Hence, a desired amount of the perfume emitting material is attached to the web.

The invention claimed is:

1. A double wrapper cigarette having a triple layer structure, comprising:

a rod-shaped filler including a tobacco material, a double wrapper wrapped around said rod-shaped filler, said double wrapper including an inner wrapper surrounding said filler without overlap of opposite side edges thereof, and an outer wrapper surrounding said inner wrapper, said outer wrapper having an overlap of opposite side edges thereof, and a perfume emitting layer provided between said inner wrapper and said outer wrapper thereby forming the cigarette having the triple layer structure, wherein said perfume emitting layer includes a perfume material for weakening odor of sidestream smoke of the cigarette and carrier glue for carrying the perfume material, wherein the perfume material is in powder form or in grain form, wherein the opposite side edges of said outer wrapper are joined to each other by seam glue, and wherein the carrier glue of said perfume emitting layer is applied to an entire outer surface of said inner wrapper to form an adhesive layer portion on the outer surface of said inner wrapper, and the perfume material of said perfume emitting layer is diffused over the adhesive layer portion to form a layer portion of the perfume material.

2. The double wrapper cigarette according to claim 1, wherein said inner wrapper and said outer wrapper include an additive for reducing the sidestream smoke.

3. The double wrapper cigarette according to claim 1, wherein the carrier glue is polyvinyl acetate glue.

4. The double wrapper cigarette according to claim 1, wherein said carrier glue of said perfume emitting layer and the seam glue are made of an identical adhesive.

5. A manufacturing machine for manufacturing a double wrapper cigarette having a triple layer structure, the double wrapper cigarette including a rod-shaped filler including a tobacco material, a double wrapper wrapped around said rod-shaped filler, said double wrapper including an inner wrapper surrounding said filler without overlap of opposite side edges thereof, and an outer wrapper surrounding said inner wrapper, said outer wrapper including overlap of opposite side edges thereof, and a perfume emitting layer provided between said inner wrapper and said outer wrapper, the manufacturing machine comprising:

a first feeding path along which an inner web is fed for obtaining the inner wrapper, a second feeding path along which an outer web is fed for obtaining the outer wrapper, a wrapping section for continuously forming a tobacco rod by receiving the inner and outer webs from said first and second feeding paths, laying the inner web on the outer web to thereby form a double web for said double wrapper, receiving the tobacco material on the double web, and wrapping the double web around the tobacco material to form the rod-shaped filler, a cutting section for cutting the tobacco rod formed at said wrapping section into pieces of a predetermined length of the double wrapper cigarette, and a perfume material supply device located along said first feeding path, said perfume material supply device being so provided as to apply material including a perfume material for weakening odor of sidestream smoke of the cigarette onto the inner web fed along said first feeding path so as to form a perfume emitting layer to be disposed between the inner and outer webs of the double web, the perfume emitting layer providing the triple layer structure to the cigarette, wherein said perfume emitting layer covers an entire outer circumferential surface of said inner wrapper, and includes the perfume material and carrier glue for carrying the perfume material, and wherein the perfume material is in powder form or in grain form, wherein the opposite side edges of said outer wrapper are joined to each other by seam glue, and said perfume emitting layer is formed over the outer circumferential surface of said inner wrapper, wherein said perfume material supply device includes:

a glue applicator for applying the carrier glue onto an entire outer surface of the inner web to thereby make an adhesive layer portion, and a diffuser for diffusing the perfume material in powder or grain form over the adhesive layer portion of the inner web to form a layer portion of the perfume material, wherein said diffuser includes:

a first brush roller rotatably located under said first feeding path, for blowing up the perfume material toward said adhesive layer portion of the inner web, a second brush roller rotatably located downstream of said first brush roller, for removing a surplus of the perfume material attached to the adhesive layer portion, and a cover located over said first feeding path and covering a surface of the inner web opposite the first and second brush rollers.

6. The manufacturing machine according to claim 5, wherein said carrier glue of said perfume emitting layer and the seam glue are made of an identical adhesive.

7. A method of manufacturing a double wrapper cigarette having a triple layer structure, the double wrapper cigarette including a rod-shaped filler including a tobacco material, a double wrapper wrapped around said rod-shaped filler without overlap, said double wrapper including an inner wrapper surrounding said filler without overlap of opposite side edges thereof, and an outer wrapper surrounding said inner wrapper, said outer wrapper having overlap of opposite side edges thereof, and a perfume emitting layer provided between said inner wrapper and said outer wrapper thereby forming the cigarette with the triple layer structure, the method of manufacturing comprising the steps of:

feeding an inner web and an outer web to a wrapping section of a cigarette manufacturing machine, and, at an inlet of the wrapping section, laying the inner web on the outer web to thereby form a double web for said double wrapper, the inner wrapper being obtained from the inner web, and the outer wrapper being obtained from the outer web, applying material including a perfume material for weakening odor of sidestream smoke of the cigarette onto the inner web by means of a perfume material supply device thereby forming the perfume emitting layer to be disposed between said inner and outer wrappers of said double wrapper while the inner and outer webs are being fed, the perfume emitting layer covering an entire outer surface of the inner web, and including the perfume material and carrier glue for carrying the perfume material;

supplying the tobacco material onto the double web at the inlet of the wrapping section, forming a tobacco rod continuously by wrapping the double web around the tobacco material while the double web is passing through the wrapping section together with the tobacco material, in order to form the rod-shaped filler, and cutting the tobacco rod into pieces of a predetermined length, thereby forming the double wrapper cigarette with the triple layer structure, wherein the perfume material is in powder form or in grain form, wherein the opposite side edges of said outer wrapper are joined to each other by seam glue, and said perfume emitting layer is formed over the outer circumferential surface of said inner wrapper, wherein said perfume material supply device includes:

a glue applicator for applying the carrier glue onto an entire outer surface of the inner web to thereby make an adhesive layer portion, and a diffuser for diffusing the perfume material in powder or grain form over the adhesive layer portion of the inner web to form a layer portion of the perfume material, wherein said diffuser includes:

a first brush roller rotatably located under said first feeding path, for blowing up the perfume material toward said adhesive layer portion of the inner web, a second brush roller rotatably located downstream of said first brush roller, for removing a surplus of the perfume material attached to the adhesive layer portion, and a cover located over said first feeding path and covering a surface of the inner web opposite the first and second brush rollers.

8. The method of manufacturing a double wrapper cigarette according to claim 7, wherein said carrier glue of said perfume emitting layer and the seam glue are made of an identical adhesive.

* * * * *